US005335720A

United States Patent [19]

Ogushi et al.

[11] Patent Number: 5,335,720

[45] Date of Patent: Aug. 9, 1994

[54] HEAT PIPE

[75] Inventors: Tetsurou Ogushi; Masaaki Murakami; Kazuyoshi Yabuchi, all of Amagasaki; Akira Yao, Kamakura, all of Japan

[73] Assignee: Mitsubishi Denki Kabushiki Kaisha, Tokyo, Japan

[21] Appl. No.: 925,162

[22] Filed: Aug. 6, 1992

[30] Foreign Application Priority Data

Aug. 9, 1991 [JP] Japan ..... 3-200563
Apr. 24, 1992 [JP] Japan ..... 4-106474

[51] Int. Cl.[5] ..... F28D 15/02
[52] U.S. Cl. ..... 165/104.26; 122/366
[58] Field of Search ..... 165/104.26; 122/366

[56] References Cited

U.S. PATENT DOCUMENTS 3,528,494 9/1970 Levedahl ..... 165/104.26
3,734,173 5/1973 Moritz ..... 165/104.26
4,846,263 7/1989 Miyazabi et al. ..... 165/104.26

FOREIGN PATENT DOCUMENTS 127091 7/1983 Japan ..... 165/104.26

OTHER PUBLICATIONS

T. Ogushi et al., "Composite Wick Heat Pipes", *Advances in Heat Pipe Technology,* Proceedings of the IVth International Heat Pipe Conference, Sep. 7-10, 1981, London, UK, pp. 651-663.

W. E. Ellis, "The Space Active Thermal Control Technical Challenge", published by NASA, 27th Aerospace Sciences Meeting, Jan. 9 ∝ 12, 1989 (AIAA 1989), Reno Nevada, pp. 1-12.

*Primary Examiner*—Albert W. Davis, Jr.
*Attorney, Agent, or Firm*—Burns, Doane, Swecker & Mathis

[57] ABSTRACT

A heat pipe comprising a hermetic shell tube, a heat conveying fluid within the shell tube and a plurality of capillary circumferential or axial grooves provided entirely of an inner surface of the shell. A capillary axial channel structure which includes axially extending plates defining a U-shaped or V-shaped channels therebetween circumferential grooves and having an opening defining therein a meniscus of the heat conveying fluid in the liquid phase at least in the evaporator section and the condenser section. The capillary axial channel structure may comprise an inner tube for defining a tubular, axially extending capillary space therebetween. The inner tube has open ends disposed within the evaporation and condensation sections for allowing the heat conveying fluid to flow therethrough.

8 Claims, 7 Drawing Sheets

HEAT PIPE

BACKGROUND OF THE INVENTION

This invention relates to a heat pipe and, more particularly, to a heat pipe for conveying heat from an evaporation section to a condensation section by circulating a working fluid between the evaporation section and the condensation section.

FIG. 8 illustrates one example of a conventional composite wick heat pipe disclosed in "Heat Pipe Theory and Practice" S. W. Chi, in which 1 is an evaporation section and 2 is a condensation section. FIG. 9*a* is a vertical sectional view of the evaporation section 1, and FIG. 9*b* is a vertical sectional view of the condensation section 2. In these FIGURES, reference numeral 3 designates a first capillary material which is a coarse felt material disposed at the center of a shell tube 10, and 4 designates a second capillary material attached to the inner surface 5 of the shell tube 10. A working fluid or a heat conveying medium such as ammonia, Freon (trade name) and the like is disposed within the first and the second capillary materials 3 and 4. Reference numeral 6 is a heat source such as an electronic device to be cooled and attached to one end of the shell tube 10, and 7 is a cooling unit such as a radiator attached to the other end of the shell tube 10.

With the conventional heat pipe as above described, when one end of the heat pipe is heated by the heat source 6, the working fluid in the form of liquid impregnated in the second capillary material 4 attached to the inner surface 5 of the shell tube 10 is heated and evaporated. The evaporated working fluid flows through a vapor phase region 8 defined in spaces above and below the first capillary material 3 as shown by arrows A in FIG. 8 into the condensation section 2, where it is cooled and condensed by the radiator 7. The condensed working fluid penetrates the second capillary material 4 as shown by arrows B in FIG. 8 and then into the first capillary material 3 disposed at the central portion of the pipe through the capillary action as shown by arrows C in FIG. 9*b*. The working fluid which penetrates into the first capillary material 3 is further caused to flow by capillary action through the first capillary material 3 as shown by arrows D in FIG. 8 into the evaporation section 1, where it flows into the second capillary material 4 as shown by arrows E in FIG. 9*a* and is heated and evaporated again by the heat source 6. The heat is thus conveyed from the evaporation section 1 to the condensation section 2 with a small temperature difference by the circulation of the working fluid.

Since a conventional composite wick heat pipe is constructed as above described, the working fluid vapor or a non-evaporating gas such as air generated or trapped within the first capillary material 3 is very difficult to purge and once such gas is trapped and stays in the capillary material, the flow of the working fluid is impeded, whereby the heat conveying capacity of the heat pipe decreases. This may cause the temperature of the evaporation section 1 of the heat pipe to increase rapidly, so that the temperature of the electronic unit 6 to be cooled increases, which causes the failure of or a decrease of the reliability of the electronic unit 6 to be cooled.

SUMMARY OF THE INVENTION

Accordingly, one object of the present invention is to provide a heat pipe which has a large heat conveying capacity.

Another object of the present invention is to provide a heat pipe which is reliable.

With the above objects in view, the heat pipe of the present invention comprises a hermetic shell tube defining therein a closed space including an evaporation section and a condensation section and in which a heat conveying fluid transformable between a liquid phase and a vapor phase is disposed. A plurality of capillary circumferential grooves provided on substantially the entire inner surface of the shell tube and a capillary axial channel structure axially extending through the substantially entire length of the shell tube are provided in the shell tube. The axial channel structure comprises axially extending elongated plates which define therebetween a capillary axial channel of U- or V-shaped cross section connected to the circumferential grooves and has an opening defining therein a meniscus of the heat conveying fluid in the liquid phase at least in the evaporation section and the condensation section. The axial channel structure may be formed in the shell tube wall.

Alternatively, the heat pipe may comprise a plurality of capillary axial grooves provided on substantially the entire inner surface of the shell tube and a circumferential channel structure defining therein a capillary circumferential channel connected to the axial grooves, and the axial channel structure is provided for defining a capillary axial channel connected to the capillary circumferential channel.

Further, the axial channel structure may comprise an inner tube coaxially disposed within the shell tube for defining a substantially tubular, axially extending capillary space therebetween, the capillary space defining therein a meniscus of the heat conveying fluid in the liquid phase at least in the evaporation and condensation regions, the inner tube having open ends disposed within the evaporation and condensation regions for allowing the heat conveying fluid to flow therethrough.

BRIEF DESCRIPTION OF THE DRAWINGS

The present invention will become more readily apparent from the following detailed description of the preferred embodiment of the present invention taken in conjunction with the accompanying drawings, in which.

DESCRIPTION OF THE PREFERRED EMBODIMENTS

Figure 1:
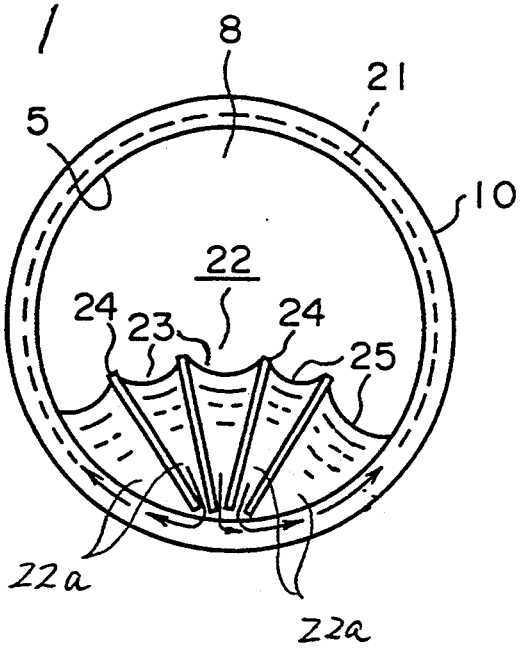
FIG. 1 is a cross-sectional view of one embodiment of the heat pipe of the present invention.
Figure 8:
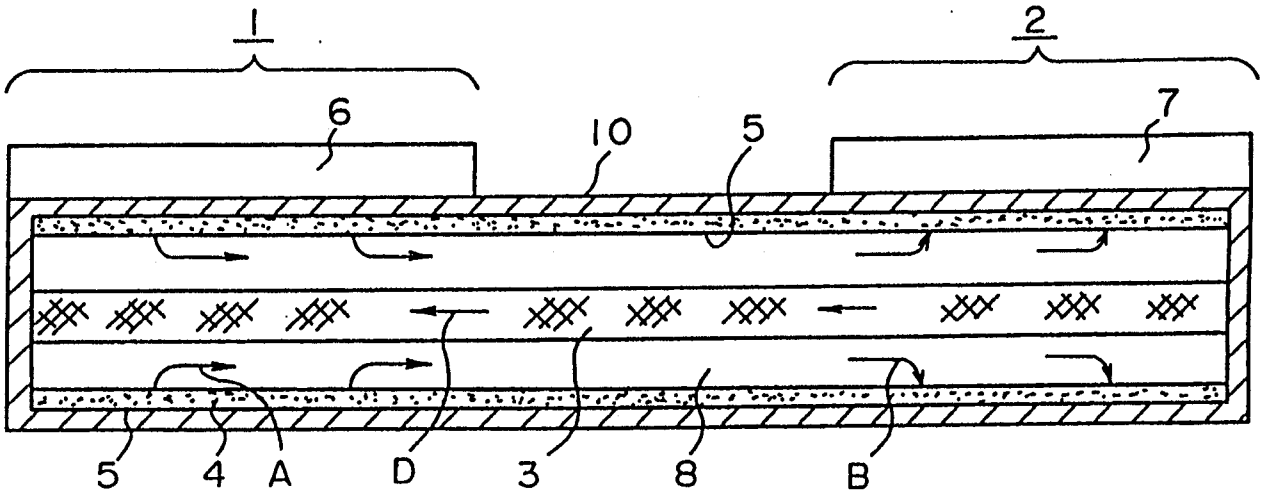
FIG. 8 PRIOR ART
FIG. 8 is a longitudinal sectional view of one example of a conventional composite wick heat pipe.
Figure 9B:
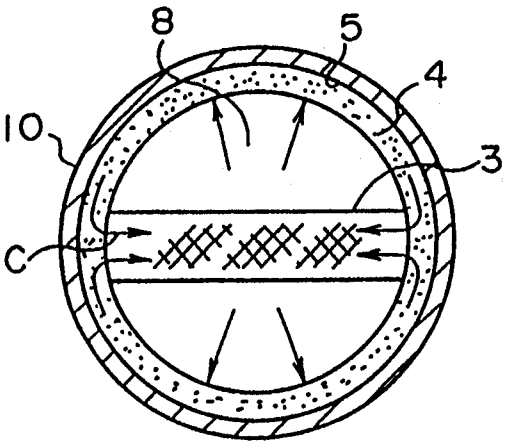
FIG. 9b PRIOR ART
FIG. 9*b* is a cross-sectional view of the saturation section of the composite wick heat pipe shown in FIG. 8.
Figure 9A:
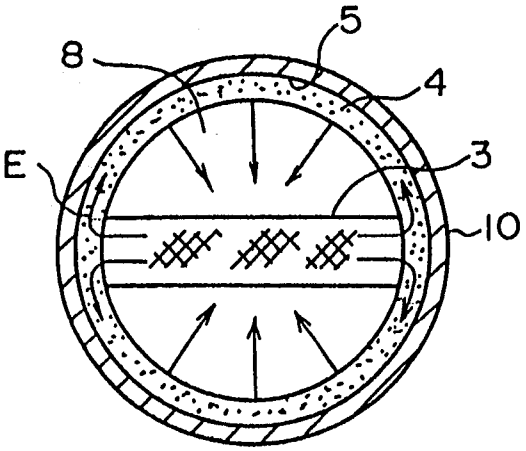
FIG. 9a PRIOR ART
FIG. 9*a* is a cross-sectional view of the evaporation section of the composite wick heat pipe shown in FIG. 8.

FIG. 1 illustrates cross-sectional view of a heat pipe constructed in accordance with the present invention, which comprises a cylindrical hermetic shell tube 10 defining therein a closed space 8 including an evaporation section 1 and a condensation section 2 (not shown in FIG. 1) at closed ends closed by end plates (not shown) similar to those illustrated in FIG. 8. A heat conveying working fluid such as Freon (trade name) is disposed within the shell tube 10. The heat conveying fluid may be any suitable known fluid transformable between a liquid phase and a vapor phase according to its heat balance.

According to the present invention, a plurality of capillary circumferential grooves 21 are formed side-by-side relationship over substantially the entire inner surface 5 of the shell tube 10 so that substantially the entire inner surface 5 of the shell tube 10 is maintained in a wet state by the heat conveying fluid. Also provided within the shell tube 10 are a plurality of axially extending elongated plates 24 disposed within the shell tube 10 and constituting a capillary axial channel structure 22 axially extending through the entire axial length of the shell tube 10. The elongated plates 24 are supported from the end plates (not shown) of the shell tube 10 in a fan-shaped arrangement defining a plurality of capillary axial channels **22*a*** each having a substantially V-shaped cross-section.

Each of the capillary axial channels **22*a* is connected to and in communication with the capillary circumferential grooves 21 at it narrower side and having a wider opening 23 which defines therein a meniscus 25 of the heat conveying fluid in the liquid phase throughout the entire length of the capillary axial channels 22*a*. The meniscus 25 of the heat conveying fluid is in contact with a vapor region 8** which is the inner space filled with the vapor of the heat conveying fluid.

With this heat pipe, in the evaporation section, the working fluid in the form of liquid within the capillary circumferential grooves 21 are heated and evaporated by the heat source (not shown) similar to the heat source 1 illustrated in FIG. 8. The evaporated working fluid in the evaporation section 1 to which a cooler (not shown) similar to the cooler 2 illustrated in FIG. 8 is attached is moved through the inner space 8 of the shell tube 10 toward the condensation section 2 because of a pressure difference therebetween, where it is cooled and condensed into liquid on the inner surface 5 of the shell tube 10 and collected in the capillary circumferential grooves 21. The condensed fluid in the condensation section is then collected into the V-shaped capillary axial channels **22*a* of the capillary axial channel structure 22 by the capillary action as illustrated in FIG. 1 and capillarily flows back therethrough to the evaporation section 1**.

It is seen that the working fluid in the V-shaped capillary axial channels **22*a* has the meniscus 25 in the opening 23 facing toward the vapor region of the inner space 8 of the shell tube 10. The working fluid in the capillary axial channels 22*a* is supplied by the capillary action to the capillary circumferential grooves 21 as it flows along the axial channels 22*a*, but the working fluid is most rapidly supplied to the circumferential grooves 21 in the evaporation section of the heat pipe. The working fluid supplied to the circumferential grooves 21** is again heated and evaporated to repeat the above-described phase cycle.

According to the heat pipe of the present invention, the V-shaped capillary axial channels **22*a* have the V-shaped cross-sectional configuration which has relatively large openings 23, so that even when a vapor or a non-condensable gas is generated within the capillary axial channels 22*a*, they are easily purged therefrom to the vapor region 8 due to the configuration of the capillary axial channels 22*a*. Therefore, the axial flow of the heat conveying fluid is not impeded by the trapped vapor or gas in the capillary axial channels 22*a* as has been in the conventional design. Also, since the fan-shaped channel structure 22 is composed only of the elongated plates 24**, the flow resistance to the heat conveying fluid is small. Therefore, the heat pipe of the present invention is reliable, has a large maximum heat conveying capacity, a simple structure and is easy to manufacture.

Figure 2:
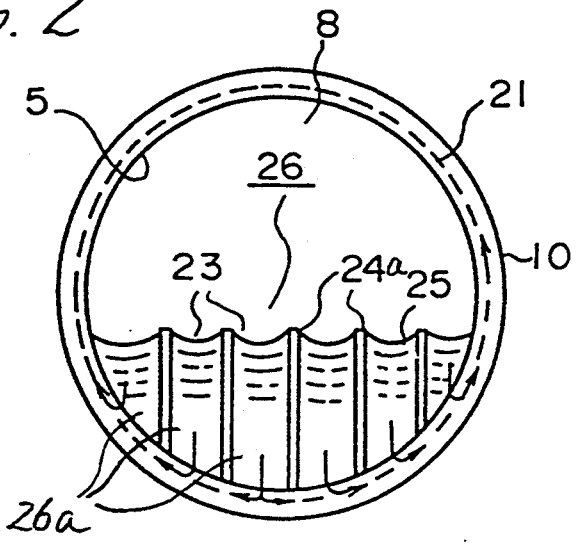
FIG. 2 is a cross-sectional view of another embodiment of the heat pipe of the present invention.

FIG. 2 illustrates another embodiment of the heat pipe of the present invention, in which the capillary axial channel structure 26 comprises a plurality of elongated plates **24*a* arranged in parallel to each other so that each of the capillary axial channels 26*a* defined between the plates 24*a* and the wall of the shell tube 10 has a substantially U-shaped cross section. The elongated plates 24*a* are supported at their opposite ends by the tube end plates (not shown) as in the previous embodiment. In this arrangement also, the capillary axial channels 26*a* has relatively large openings 23 in communication with the vapor region 8 within the shell tube 10, so that vapor or gas generated in the liquid working fluid can be easily purged to the vapor region 8** and the smooth flow of the heat conveying medium is maintained.

Figure 3:
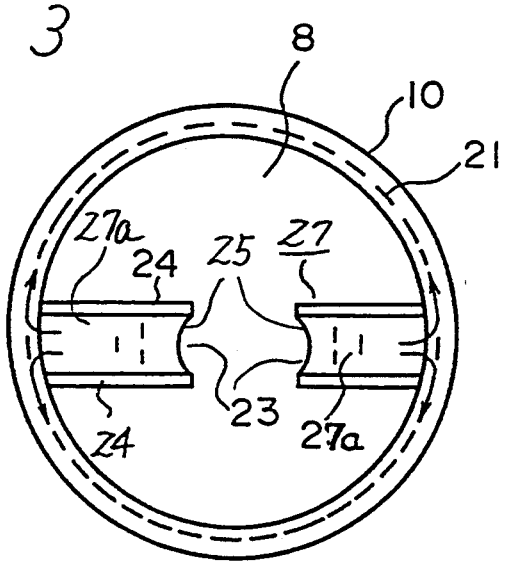
FIG. 3 is a cross-sectional view of a further embodiment of the heat pipe of the present invention.

FIG. 3 illustrates another embodiment of the heat pipe of the present invention in which the axial channel structure 27 is mounted in the shell tube 10 at substantially equal circumferential intervals therebetween. In the illustrated embodiment, the axial channel structure 27 comprises two pairs of parallel elongated plates 24 which define two axial channels **27*a* disposed within the shell tube 10** at substantially diametrically opposite circumferential positions.

Figure 4:
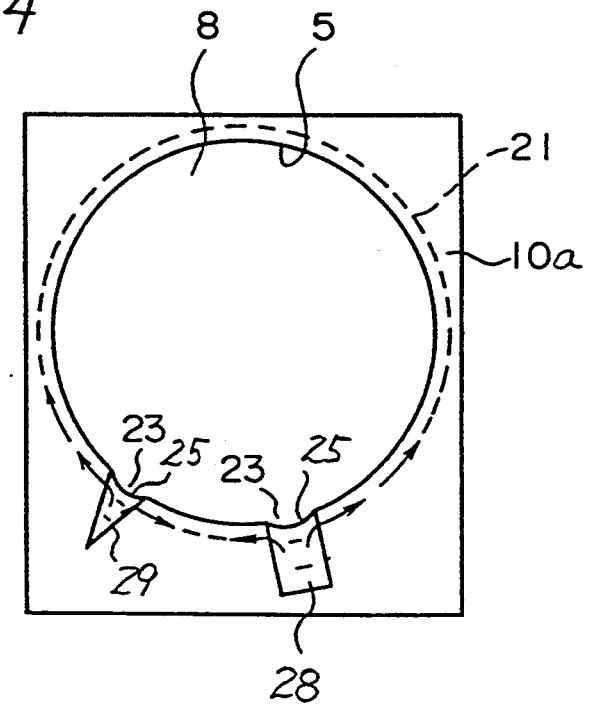
FIG. 4 is a cross-sectional view of a still another embodiment of the heat pipe of the present invention.

FIG. 4 illustrates another example of an axial channel structure applicable in the heat pipe of the present invention. It is seen that the shell tube **10*a* has a thick wall and that a first axial channel structure 28 having a substantially U-shaped cross section is formed in the thick tube wall. Similarly, a second axial channel structure 29 having a substantially V-shaped cross section is formed in the thick shell tube 10*a*. The capillary axial channels 28 and 29 are connected to the capillary circumferential grooves 21 at their open ends having openings 23 in which meniscus 25** is formed. The axial channel structures of the above two different types may be used together as illustrated if so desired, but the use of the same type of axial channel structure is preferable from the view point of easy manufacturing.

With the axial channel structure as above described and illustrated in FIG. 4, the channel structure does not project into the interior space 8 of the shell tube 10*a*. Therefore, the flow resistance of the vapor flow path to the vapor is low as compared to the previous embodiments in which the discrete channel structure projects into the inner space of the shell tube 10, so that the maximum heat conveying capacity of the heat pipe is further increased.

Figure 5:
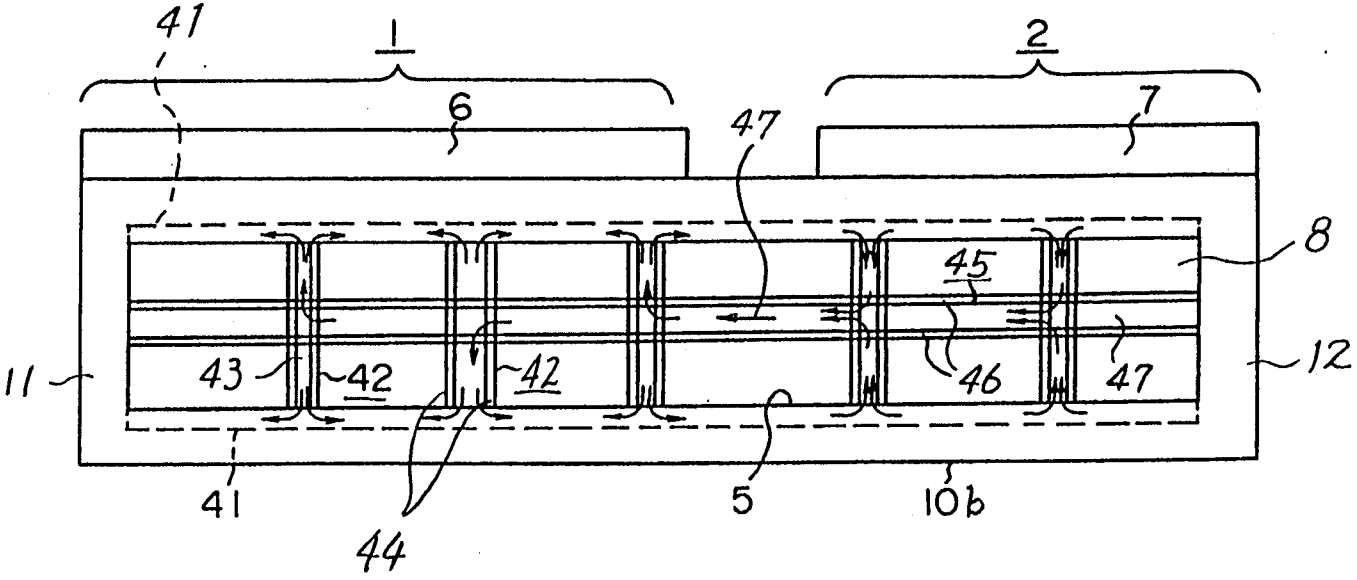
FIG. 5 is a longitudinal-sectional view of another embodiment of the composite wick heat pipe of the present invention.
Figure 6B:
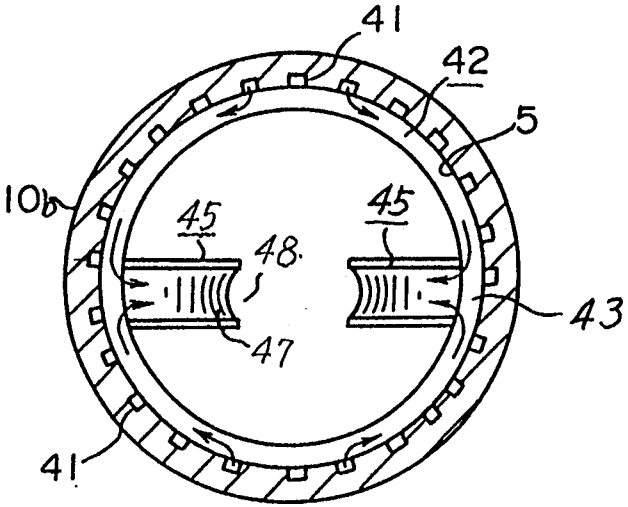
FIG. 6*b* is a cross-sectional view of the saturation section of the composite wick heat pipe shown in FIG. 5.
Figure 6A:
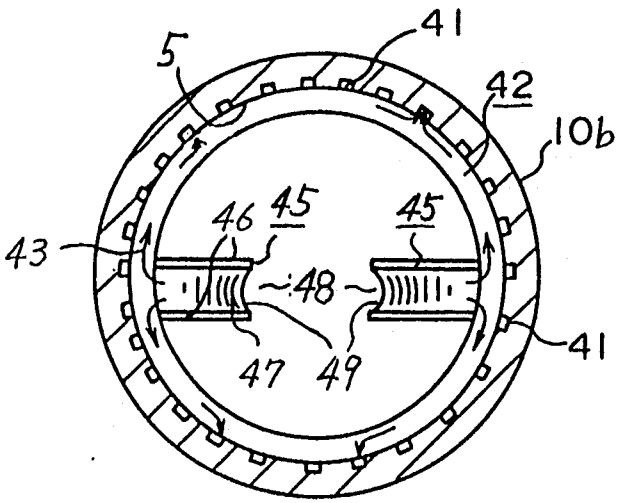
FIG. 6*a* is a cross-sectional view of the evaporation section of the composite wick heat pipe shown in FIG. 5.

FIGS. 5, 6*a* and 6*b* illustrate a schematic longitudinal sectional view of another embodiment of the heat pipe of the present invention, which comprises a hermetic shell tube 10*b* having end plates 11 and 12 defining a closed space 8 including an evaporation section 1 and a condensation section 2 and a heat conveying fluid (not shown) such as Freon (trade name) disposed within the shell tube 10*b*.

The heat pipe also comprises a plurality of capillary axial grooves 41 provided in parallel to each other on substantially the entire inner surface 5 of the shell tube 10*b*, and a plurality of circumferential channel structures 42 each defining therein a capillary circumferential channel 43 connected to the axial grooves 41. Each of the circumferential channel structures 42 comprises a pair of parallel ring members 44 attached to the inner surface 5 of the shell tube 10*b* so that the capillary circumferential channel 43 is defined therebetween.

The heat pipe further comprises an axial channel structures 45 similar to the axial channel structures illustrated in FIG. 3. The axial channel structures 45 comprises a plurality of pairs of axially extending elongated plates 46 supported within the shell tube 10*b* by the end plates 11 and 12. The elongated plates 46 extend through the substantially entire length of the shell tube 10*b* and define therebetween a capillary axial channel 47 in communication with the capillary circumferential channels 43 and having an opening 48 defining therein a meniscus 49 of the heat conveying fluid in the liquid phase. Although not illustrated, the elongated plate has several notches for accommodating and positioning the ring members 44 in place. In the illustrated embodiment, the elongated plates 46 of each channel structure 45 are arranged in parallel to each other so that the axial channel 47 defined therebetween has a substantially U-shaped cross section. While two axial channel structures 45 are positioned in a diametrically opposing relationship in the illustrated embodiment, the axial channel structures 45 may define more than three axial channels in the shell tube 10*b* at substantially equal circumferential intervals therebetween.

In FIG. 6*a*, in which the flow of the heat conveying fluid in the evaporation section 1 is shown by arrows, the heat conveying fluid in the capillary axial grooves 41 is heated and evaporated into vapor, which flows from the evaporation section 1 illustrated in FIG. 6*a* to the condensation section 2 illustrated in FIG. 6*b*. The vapor of the working fluid reached in the condensation section is cooled and condensed into liquid on the inner surface 5 of the shell tube 10*b*. The condensed fluid is collected in the capillary axial grooves 41 and flows through the capillary circumferential channels 43 to eventually flows into the capillary axial channels 47. Then, the working fluid in the liquid state collected in the capillary axial channels 47 in the condensation section 2 flows therethrough to the axial channels 47 in the evaporation section 1 from where it further flows through the capillary circumferential channels 43 into the capillary axial grooves 41 distributed over the entire inner surface 5 of the shell tube 10*b*. The distributed working fluid is heated and evaporated again into the vapor region 8 and flows toward the condensation section 2. This cycle is repeated to convey heat from the evaporation section to the condensation section 2 by the heat conveying fluid.

In this embodiment, the axial capillary grooves 41 can be much more easily manufactured and have higher reliability than the capillary axial grooves 21 used in the previous embodiments, so that the resultant heat pipe is inexpensive and reliable.

Figure 7:
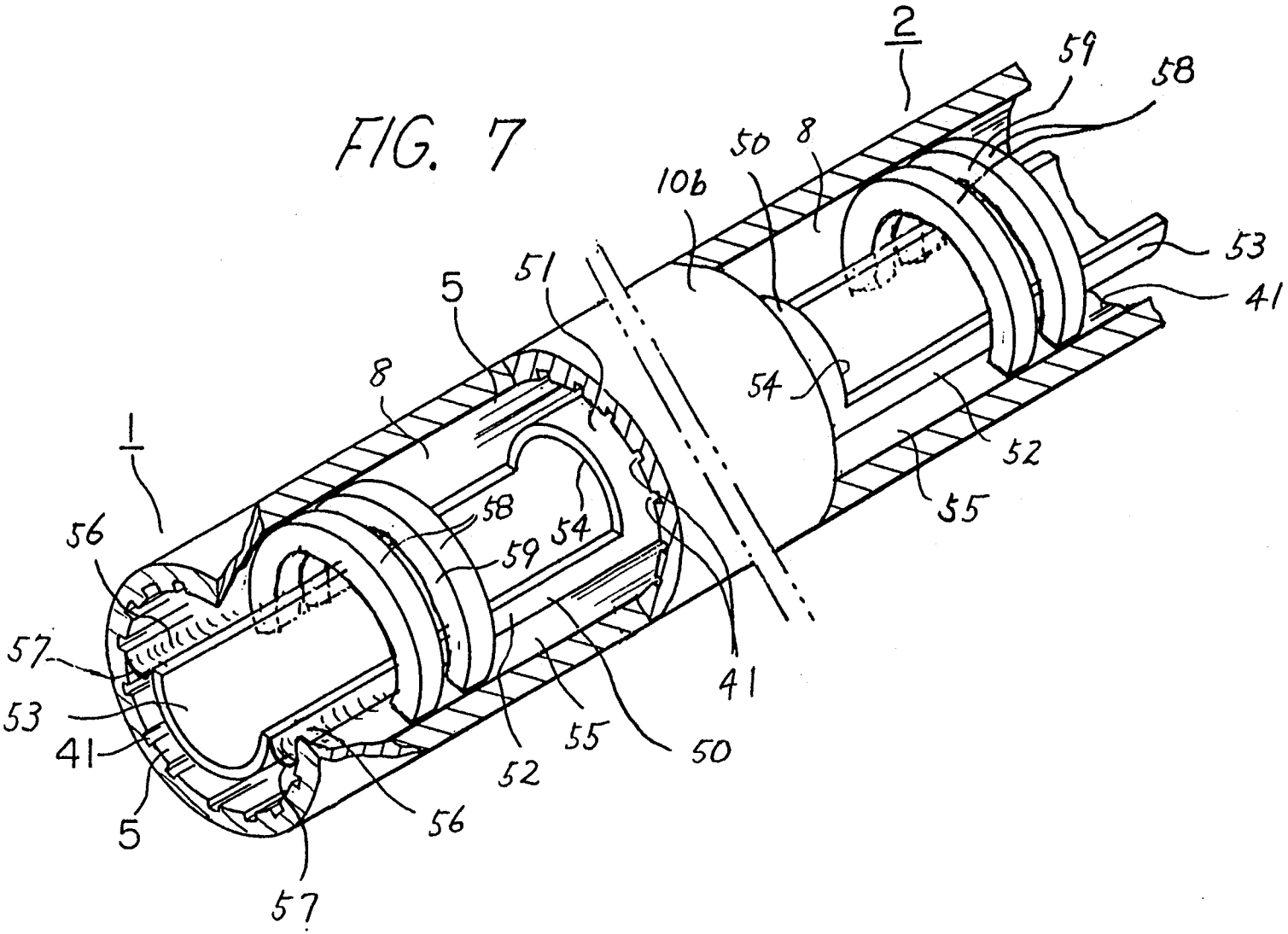
FIG. 7 is a partially cut-away perspective view of a further embodiment of the composite wick heat pipe of the present invention.

FIG. 7 illustrates, in a partially cut-away, perspective view, still another embodiment of the heat pipe of the present invention. The heat pipe comprises a hermetic shell tube 10*b* having closed ends (not shown) defining a closed space including the evaporation section 1 and the condensation section 2. The closed space is filled with a heat conveying fluid such as Freon (trade name) disposed within the shell tube 10*b*, the fluid being transformable between a liquid phase and a vapor phase in the evaporation and the condensation sections 1 and 2. A plurality of capillary axial grooves 41 similar to those of the previous embodiment shown in FIGS. 5, 6*a* and 6*b* are provided on substantially the entire inner surface 5 of the shell tube 10*b*. The above-described construction is the same as that of the previous embodiment.

According to the present invention, the heat pipe comprises an inner tube 50 co-axially disposed within the shell tube 10*b* with a substantially tubular capillary space 51 defined between the shell tube 10*b* and the inner tube 50. The inner tube 50 has open ends 52 disposed within the evaporator and condenser sections 1 and 2 for allowing the heat conveying fluid to flow therethrough. It is seen that each of the open ends 52 of the inner tube 50 of the illustrated embodiment is composed of an axially extending trough or a half tube 53 having a substantially C-shaped cross section. In other words, the inner tube 50 is provided at the opposite ends with a notch 54. The inner tube 50 is supported at its opposite ends by the end plates (not shown) similar to those shown in FIG. 5 so that the capillary tubular space 51, which connects the capillary axial grooves 41 formed in the inner surface 5 of the shell tube 10*b*, is defined between the shell tube 10*b* and the inner tube 50 over the entire length of the heat pipe. Since there are large notches 54 in the inner tube 50 in the evaporation section 1 and the condensation section 2, no capillary space is defined in the position corresponding to the notches 54 and only a capillary space 55 of a substantially C-shaped cross section is defined between the shell tube 10*b* and the trough member 53. The C-shaped capillary space 55 has an opening 56 which has a meniscus 57 of the heat conveying fluid in the liquid phase at least in the evaporator and condenser sections 1 and 2. The openings 56 or the meniscus 57 is open toward the vapor region 8 of the heat pipe.

In the evaporation section I and the condensation section 2 where the inner tube 50 is provided with the large notches 54, a pair of parallel substantially C-shaped ring members 58 are concentrically disposed between the shell tube 10*b* and the inner tube 50 and along the inner surface 5 of the inner tube 50 for defining therebetween a capillary circumferential channel 59 connected to the capillary axial grooves 41 disposed in the shell tube 10*b* facing the notches 54 of the inner tube 50.

When the evaporation section 1 of the heat pipe is heated by a heater (not shown) similar to that illustrated in FIG. 5, the heat conveying fluid such as Freon (trade name) in the liquid phase which is in the capillary axial grooves 41 in the inner surface 5 of the shell tube 10*b* in the area corresponding to the notch 54 of the evaporation section 1 evaporates. The evaporated heat conveying fluid flows into the open end 52 of the inner tube 50 to flow through the inner tube 50 toward the other open end 52 of the inner tube 50 in the condensation section 2. The vapor which reaches the other open end 52 flows out through the notch 54 and condenses on the inner surface 5 of the shell tube 10*b* which is maintained at a lower temperature by a cooler (not shown) similar to that illustrated in FIG. 5. The condensed liquid is collected in the capillary axial grooves 41 and caused to flow through the capillary circumferential channel 59 between the C-shaped ring members 58 into the C-shaped capillary space 55 which is defined between the shell tube 10*b* and the C-shaped trough member 53 of the inner tube 50 and which has the opening 56 facing toward the vapor region 8 of the shell tube 10*b* and having a meniscus 57 of the liquid heat conveying medium in the opening 56. The liquid heat conveying medium is conveyed back therefrom to the evaporation section 1 through the capillary tubular space 51 by capillary action. Since the capillary tubular space 51 extends the entire circumference around the inner tube 50 and has a large cross-sectional area, the pressure loss due to the flow of the working fluid is small and the heat conveying capacity is much improved. The heat conveying fluid reaches the evaporation section 1 and then flows through the capillary circumferential channel 59 to be distributed into the capillary axial grooves 41. This cycle is repeated to convey heat from the evaporation section 1 to the condensation section 2. With this arrangement, since the capillary space is defined by a concentric tubes, the heat pipe can be bent in any direction. If it is desired, the width dimension of the trough member 53 can be gradually reduced toward the outer end so that the opening 56 of the C-shaped capillary space 55 has a width dimension increasing toward the outer end of the heat pipe.

As has been described, the heat pipe of the present invention comprises a plurality of capillary circumferential grooves provided on substantially an entire inner surface of the shell tube and a capillary axial channel structure axially extending through the substantially entire length of the shell tube are provided in the shell tube. The axial channel structure comprises axially extending elongated plates which defines therebetween a capillary axial channel of U- or V-shaped cross section connected to the circumferential grooves and has an opening defining therein a meniscus of the heat conveying fluid in the liquid phase at least in the evaporation section and the condensation section. The axial channel structure may be formed in the shell tube wall.

Alternatively, the heat pipe may comprise a plurality of capillary axial grooves provided substantially an entire inner surface of the shell tube and a circumferential channel structure defining therein a capillary circumferential channel connected to the axial grooves, and the axial channel structure is provided for defining a capillary axial channel connected to the capillary circumferential channel.

Further, the axial channel structure may comprise an inner tube co-axially disposed within the shell tube for defining a substantially tubular, axially extending capillary space therebetween, the capillary space defining therein a meniscus of the heat conveying fluid in the liquid phase at least in the evaporation and condensation regions, the inner tube having open ends disposed within the evaporation and condensation regions for allowing the heat conveying fluid to flow therethrough.

Therefore, a reliable heat pipe which has a large heat conveying capacity can be obtained.

What is claimed is:

1. A heat pipe comprising:

a hermetic shell tube defining a closed space including an evaporation section and a condensation section;

a heat conveying fluid disposed within said shell tube, said fluid being transformable between a liquid phase and a vapor phase in said evaporation and condensation sections;

a plurality of capillary axial grooves provided on substantially an entire inner surface of said shell tube;

a circumferential channel structure defining therein a capillary circumferential channel connected to said axial grooves; and an axial channel structure axially extending through the substantially entire length of said shell tube for defining a capillary axial channel connected to said capillary circumferential channel and having an opening defining therein a meniscus of said heat conveying fluid in the liquid phase at least in said evaporator section and said condenser section.

2. A heat pipe as claimed in claim 1, wherein said axial channel structure comprises a plurality of axially extending elongated plates disposed within said shell tube defining said axial channel therebetween.

3. A heat pipe as claimed in claim 2, wherein said elongated plates are arranged in parallel to each other so that said channel defined therebetween has a substantially U-shaped cross section.

4. A heat pipe as claimed in claim 1, wherein said axial channel structure defines at least two axial channels disposed within said shell tube at substantially equal circumferential intervals therebetween.

5. A heat pipe as claimed in claim 1, wherein said axial channel structure comprises an inner tube co-axially disposed within said shell tube for defining a substantially tubular, axially extending capillary space therebetween, said capillary space defining therein a meniscus of said heat conveying fluid in the liquid phase at least in said evaporation and condensation sections, said inner tube having open ends disposed within said evaporation and condensation sections for allowing said heat conveying fluid to flow therethrough.

6. A heat pipe as claimed in claim 5, wherein said open ends of said inner tube comprises side openings formed in side walls of said inner tube, and said circumferential channel structure comprises a pair of substantially C-shaped ring members placed over said side openings.

7. A heat pipe comprising:

a hermetic shell tube defining a closed space including an evaporation section and a condensation section;

a heat conveying fluid disposed within said shell tube, said fluid being transformable between a liquid phase and a vapor phase in said evaporation and condensation sections;

a plurality of capillary axial grooves provided on substantially an entire inner surface of said shell tube; and an inner tube co-axially disposed within said shell tube with a substantially tubular capillary space between said shell tube and said inner tube, said capillary space defining therein a meniscus of said heat conveying fluid in the liquid phase at least in said evaporator and condenser sections, said inner tube having open ends disposed within said evaporator and condenser sections for allowing said heat conveying fluid to flow therethrough.

8. A heat pipe as claimed in claim 7, wherein each of said open ends of said inner tube comprises an axially extending half tube having a substantially C-shaped cross section and a pair of substantially C-shaped ring member concentrically disposed between said shell tube and said inner tube for defining therein a capillary circumferential channel connected to said capillary axial grooves disposed in the shell tube facing said open end of said inner tube.

* * * * *